US008106571B2

(12) United States Patent
Kassenaar et al.

(10) Patent No.: US 8,106,571 B2
(45) Date of Patent: Jan. 31, 2012

(54) CAPPED LAMP/REFLECTOR UNIT

(75) Inventors: Teunis Adrianus Kassenaar, Nuenen (NL); Greta Joanna Maria S'Heeren, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/738,667

(22) PCT Filed: Oct. 20, 2008

(86) PCT No.: PCT/IB2008/054296

§ 371 (c)(1),
(2), (4) Date: Apr. 19, 2010

(87) PCT Pub. No.: WO2009/053882

PCT Pub. Date: Apr. 30, 2009

(65) Prior Publication Data

US 2010/0207504 A1 Aug. 19, 2010

(30) Foreign Application Priority Data

Oct. 26, 2007 (EP) ..... 07119376

(51) Int. Cl.
*H01J 5/16* (2006.01)

(52) U.S. Cl. ..... 313/113; 313/318.01; 313/318.1; 313/318.11; 313/623

(58) Field of Classification Search ..... 31/110, 31/113, 318.01, 318.09–318.12, 623–625
See application file for complete search history.

(56) References Cited

U.S. PATENT DOCUMENTS

| | | | | |
|---|---|---|---|---|
| 2,252,476 | A | 8/1941 | Wright | |
| 4,626,734 | A * | 12/1986 | Greiler | 313/51 |
| 2004/0027835 | A1 * | 2/2004 | Delourme | 362/516 |
| 2005/0169014 | A1 | 8/2005 | Koegler, III et al. | |
| 2006/0163990 | A1 * | 7/2006 | Huizar et al. | 313/113 |
| 2007/0194680 | A1 * | 8/2007 | Treurniet et al. | 313/113 |

FOREIGN PATENT DOCUMENTS

WO 2006019951 A2 2/2006

* cited by examiner

*Primary Examiner* — Bumsuk Won
(74) *Attorney, Agent, or Firm* — John F. Salazar; Mark L. Beloborodov

(57) ABSTRACT

A capped lamp/reflector unit (1) comprising a lamp vessel (2) arranged inside a reflector (3) and a lamp cap (4) fixed to the reflector. Electrical contacts (17) are provided substantially opposite to each other on an outer surface (24) of the lamp cap. The lamp cap comprises a first (25) and a second mating and engaging part (26), preferably identical to each other. The mating parts, when assembled, cannot move relative to each other and preferably are held together by the electrical contacts (17), which for this purpose are formed as spring clamps (39). The reflector is provided with a metal sheet cladding (22) on an outer surface (23) of the reflector. Furthermore, a transparent plate (34) is provided to close the light emission window (21) of the reflector. Thus, an easily replaceable, simple and safe capped lamp/reflector unit is obtained.

6 Claims, 4 Drawing Sheets

CAPPED LAMP/REFLECTOR UNIT

FIELD OF THE INVENTION

The invention relates to a capped lamp/reflector unit according to the preamble of claim 1.

TECHNICAL BACKGROUND

Such a capped lamp/reflector unit is known from U.S. Pat. No. 4,626,734. Units of this type may for example be used for projection purposes, for example film or slide projection or projection television devices. In these applications generally a compact filament lamp or a compact high-pressure mercury discharge lamp is used with a short arc length, for example an arc length in the range of about 0.5 mm to 3 mm. In particular for the high pressure discharge lamp, relatively high voltages, typically in the range of several kVolts, are required to (re-) ignite the lamp. As a result, particularly upon (re-)ignition of the lamp there is a risk of flashover between the electrical contacts. Besides, these lamps are becoming more and more available to the consumer market, for example in beamers for slide shows in home applications. Upon failure of the lamp/reflector unit, replacement of the unit should be enabled to the layman. In the known unit, the capped electric lamp/reflector unit must be taken out of the holder in an axial direction, which involves the disadvantage that replacement of the unit is rather complex. It is a further disadvantage of the known unit that it is still relatively unsafe, as the lamp cap has both electrical contacts provided relatively close to one another.

SUMMARY OF THE INVENTION

It is an object of the invention to provide a capped lamp/reflector unit of the type as described in the opening paragraph in which the disadvantages are counteracted. This object is achieved by a capped lamp/reflector unit which is characterized by the characterizing part of claim 1. It is generally known that the humidity of the environmental atmosphere has a significant influence on the voltage at which flashover occurs. It is therefore important to choose the distance between the electrical contacts, which are exposed to the environmental atmosphere, as large as possible, as is realized in the capped lamp/reflector unit according to the invention. By means of the technical features of the characterizing part of claim 1 it is attained that the unit is relatively safe with respect to flashover, as both contacts are spaced apart as far as possible, contrary to the prior art unit, in which one electrical contact is provided centrally and one contact is provided at the outer surface of the lamp cap. Typically, with this lamp cap, flashover only occurs above several kVolts, for example 2.5 kV. Furthermore, the lamp can easily be replaced because electrical contact with the holder into which it is (to be) accommodated is readily established as it can be taken out in a radial direction, thus enabling easy maneuvering of the unit in the holder.

An embodiment of the capped lamp/reflector is characterized in that the reflector further is provided with a hollow neck-shaped portion at the neck opening, the lamp vessel having at least one seal as a part of its wall, via which seal the lamp vessel is fixed in the hollow neck-shaped portion, and the lamp cap being provided around the neck-shaped portion. Robust positioning of the lamp vessel inside the reflector and a robust connection between the lamp cap and the reflector are thus realized, as large contact areas for adhesive and cement are present.

A further embodiment of the capped lamp/reflector unit is characterized in that the lamp cap is made of light/UV-blocking material and has a cavity with one open side, the neck-shaped portion of the reflector being inserted via the open side into the cavity and fixed therein with cement. Light/UV-blocking material means material that absorbs and/or reflects visible and/or UV-radiation, for example ceramic, glass-ceramic, or high-temperature resistant plastics. The leakage of stray light and/or UV-radiation in a backward direction through the neck-shaped portion is thus counteracted. Furthermore, assembling the unit has become simpler as the risk of spilling cement during cementing of the lamp cap onto the reflector is reduced.

A still further embodiment of the capped lamp/reflector unit is characterized in that the lamp cap comprises first and second mating, engaging parts. Assembly of the capped lamp/reflector unit has become simpler as electrical connection to a single mating part of the lamp cap inside the cavity of the lamp cap can be established before the further mating part practically closes the cavity. Preferably, the first and the second mating part are identical, thus saving manufacturing costs as only one mould is required for the production of the mating parts.

Another embodiment of the capped lamp/reflector unit is characterized in that the electrical contacts are spring clamps. The spring clamps make up the electrical contacts via which the unit is electrically connected to its holder. When these electrical contacts are provided as spring clamps, assembly of the unit is simplified, as laborious manufacturing steps such as soldering, and/or fixation of said electrical contacts to the lamp cap via cementing are avoided. Preferably, the two mating parts are held together by the spring clamps, thus avoiding the need for sealing the mating parts together. Thus, a further simplification of the assembly of the capped lamp/reflector unit and an increase in the reliability of the fixation of the mating parts of the lamp cap onto the lamp/reflector unit are obtained.

Yet another embodiment of the capped lamp/reflector unit is characterized in that the neck has a profiled structure on an outer surface and each mating part has an inner profile mating with the profiled outer surface. After assembly of the capped lamp/reflector unit, this enables a better fixation of the lamp cap to the neck-shaped portion of the reflector. Preferably, the profile is chosen such that the lamp cap is fixed onto the lamp/reflector unit via interlocking, for example in that the profiled outer surface of the neck-shaped portion has a local indentation and/or protrusion, or ridges at an acute angle with the optical axis, or the structured profile is a ring-shaped circumferential ridge or groove. The fact that the mating parts of the lamp cap have corresponding, engaging inner surfaces, results in the lamp cap being fixed onto the lamp/reflector unit via interlocking. Thus, the manufacture of the capped lamp/reflector unit can be simplified, as cementing of the lamp cap onto the lamp/reflector is no longer needed.

Yet, still another embodiment of the capped lamp/reflector unit is characterized in that the reflector has an outer reflector surface which is provided with a metal cladding. Thus, a safer lamp is realized in which furthermore stray light and/or UV-radiation in undesired directions, for example backwards along the optical axis and the neck-shaped portion, is counteracted. Preferably, the capped lamp/reflector unit is provided with a transparent lid, for example a lens or a plate, in its light emission window. Thus, a further increase of the safety of the lamp is obtained, as in the case of failure of the lamp due to explosion, it is counteracted that the fragments thus formed are being scattered into the environment.

The lamp vessel could be a high-pressure mercury discharge lamp, a metal halide discharge lamp with a pair of electrodes as the light emitting element, or it could be a halogen incandescent lamp with a filament as the light-emitting element. The lamp vessel could either be single-ended or double-ended. The reflector preferably is made of hard glass, but could alternatively be made of metal, ceramic or glass ceramic. On an inner surface of the reflecting part the reflector could be coated with a specularly reflective material, for example an aluminum layer, a dichroic layer stack or a diffusely reflective layer, for example aluminum oxide. The lamp cap is made of temperature-resistant material, for example light and UV blocking hard glass, glass ceramic or ceramic, for example sintered aluminum oxide or steatite. The reflector is concave in shape, for example as a parabolic or elliptic reflector.

BRIEF DESCRIPTION OF THE DRAWINGS

The invention will be further elucidated by means of the drawing in which.

DETAILED DESCRIPTION OF PREFERRED EMBODIMENTS

Figure 1:
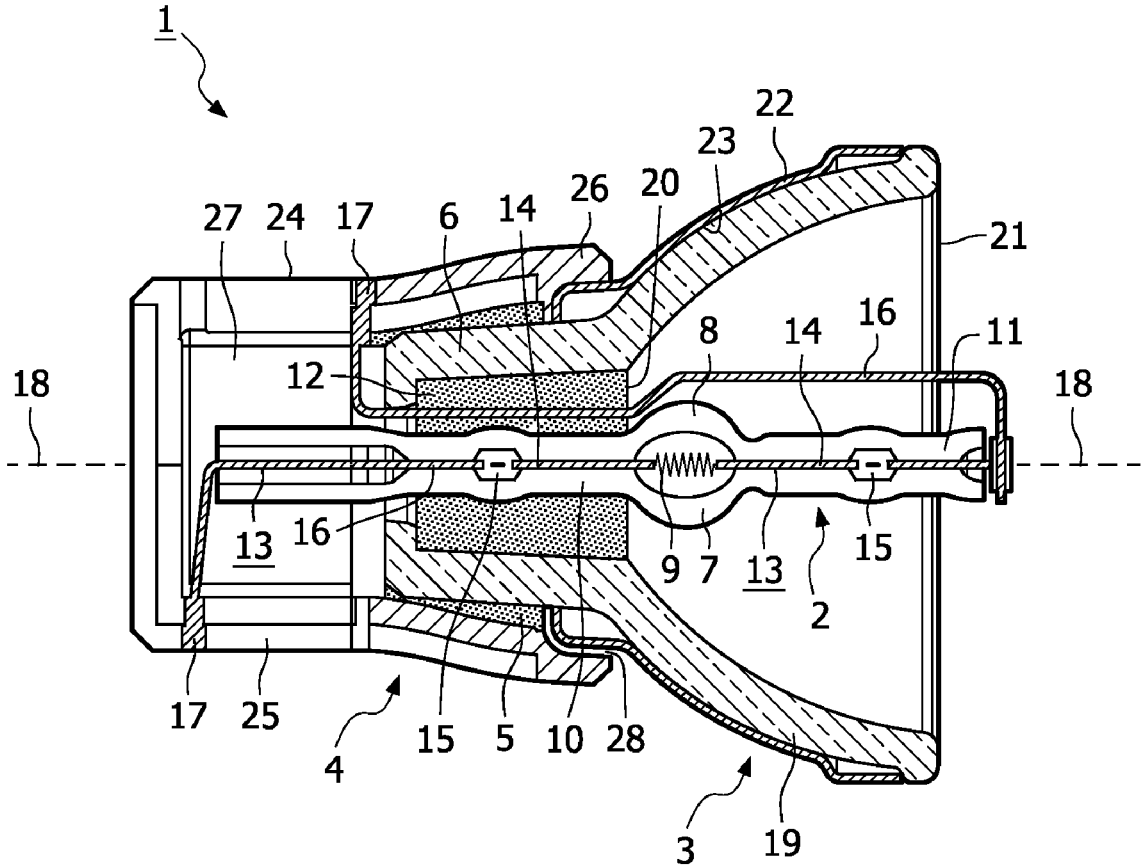
FIG. 1 is a cross section of a first embodiment of the unit of the invention.

FIG. 1 shows a first embodiment of a capped lamp/reflector unit 1 (=unit) according to the invention. The unit comprises a lamp vessel 2 arranged inside a reflector 3 and a lamp cap 4 fixed with cement 5 to a hollow neck-shaped portion 6 of the reflector. The lamp vessel comprises a wall 7 enclosing in a gastight manner a space 8 in which a light-emitting element 9 is arranged. The lamp vessel is double-ended and has a first seal 10 opposite to a second seal 11 as a part of its wall, via which first seal the lamp vessel is fixed with adhesive 12 in the hollow neck-shaped portion, the lamp cap being provided around the neck-shaped portion. The lamp vessel further has electrical current conductors 13 which extend from the light-emitting element through the seals to the exterior. Each current conductor comprises a respective internal current conductor 14, a molybdenum foil 15 and an external current conductor 16. Each external current conductor is electrically connected to a respective electrical contact 17 provided on the lamp cap.

The light-emitting element 9, in FIG. 1 a tungsten filament of a halogen lamp consuming a power of 100 Watt, is positioned on an optical axis 18 as defined by a reflecting portion 19 of the reflector. The reflecting portion extends between a neck opening 20 and a light emission window 21. The reflector is provided with a metal cladding 22, in FIG. 1 made of sheet metal, on an outer surface 23 of the reflector.

The electrical contacts are provided substantially opposite to each other on an outer surface 24 of the lamp cap. The lamp cap 4 is made of light/UV-blocking material, in FIG. 1 of a ceramic, specifically sintered aluminum oxide. The lamp cap comprises a first 25 and an identical second mating and engaging part 26. The mating parts, when assembled, cannot move with respect to each other and make up a cavity 27 with one open side 28, the neck of the reflector being inserted into the cavity and fixed therein with cement 5.

Figure 2:
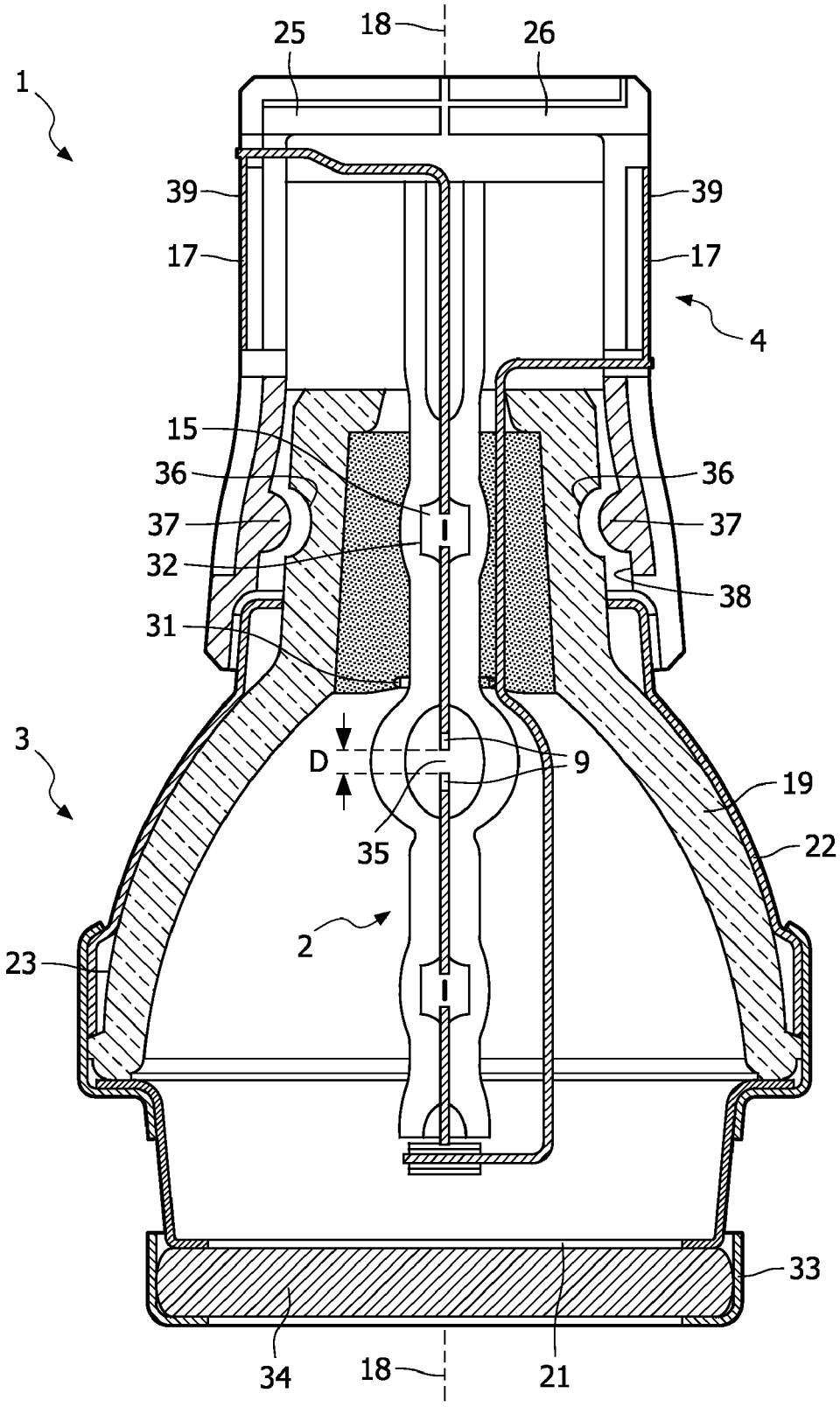
FIG. 2 is a schematic drawing of a second embodiment of the unit of the invention in cross section.

FIG. 2 shows a second embodiment of a capped lamp/reflector unit 1 (=unit) according to the invention. The lamp vessel 2 is double-ended and of the UHP-burner type, which is in general suitable for use in a high-pressure mercury discharge lamp. The lamp vessel has a filling of mercury in an amount of $\geqq 0.15$ mg/mm$^3$, leading to a pressure of about 200 bar in the space during operation of the unit, about 100 mbar Argon as a starting gas and a halogen compound, typically bromine in an amount of about $\geqq 1.10\text{-}4$ μmole/mm$^3$. The light-emitting element 9 is a pair of tungsten electrodes, having a mutual electrode distance D of typically 1.0 mm, and is positioned in a focal point 35 of the (elliptic) reflector. The lamp normally consumes a power in the range of 35 Watt to 500 Watt, in the FIG. 200 Watt. The lamp vessel is further provided with an antenna 31 around the first seal and a UV-enhancer 32, i.e. a seal-cavity around the Mo-foil 15, filled with a constituent also present in the filling of the space, to enhance relatively easy ignition of the lamp. The reflector 3 is provided on its outer surface 23 with a metal cladding 22, the cladding extends the reflecting portion 19 of the reflector in the forward direction, i.e. along the axis 18 in the direction of the light beam emitted by the unit during operation, and also provides holding means 33 for a transparent lid 34. Alternatively, the lid could be fixed to the reflector via cementing. The lid closes the light emission window 21 of the reflector. Thus, a relatively safe reflector is obtained. Furthermore, the reflector is provided with a profiled structure 36 at its neck-shaped portion. The profiled neck structure is formed by local indents, and a mating profile 37, i.e. in FIG. 2 protrusions, is provided on an inner surface 38 of the lamp cap 4, which protrusions are seated in said indents after assembly of the unit. Thus, the lamp cap is fixed onto the neck-shaped portion of the reflector via interlocking, thus making cementing of the lamp cap to the reflector redundant. Furthermore, the lamp cap is provided with spring clamps 39 as electrical contacts 17. The two mating parts 25, 26 of the lamp cap are held together by said spring clamps, the mating parts being formed in such a way that mutual displacement is counteracted (see FIG. 4).

Figure 3A:
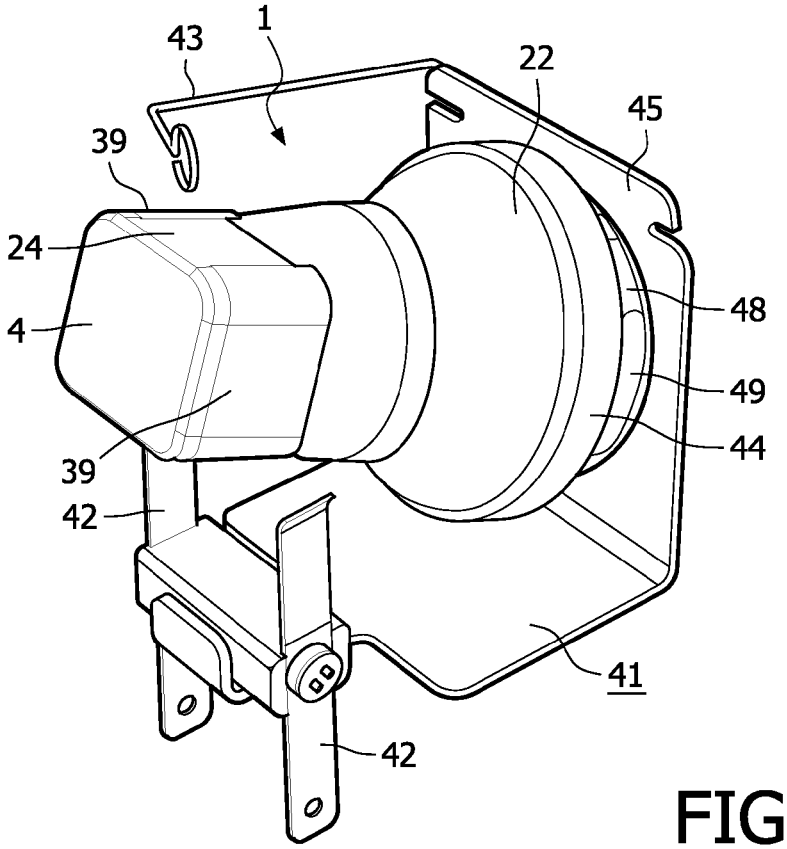
FIG. 3A shows a third embodiment of the unit with a lamp cap in one part, which unit is seated in a holder.
Figure 3B:
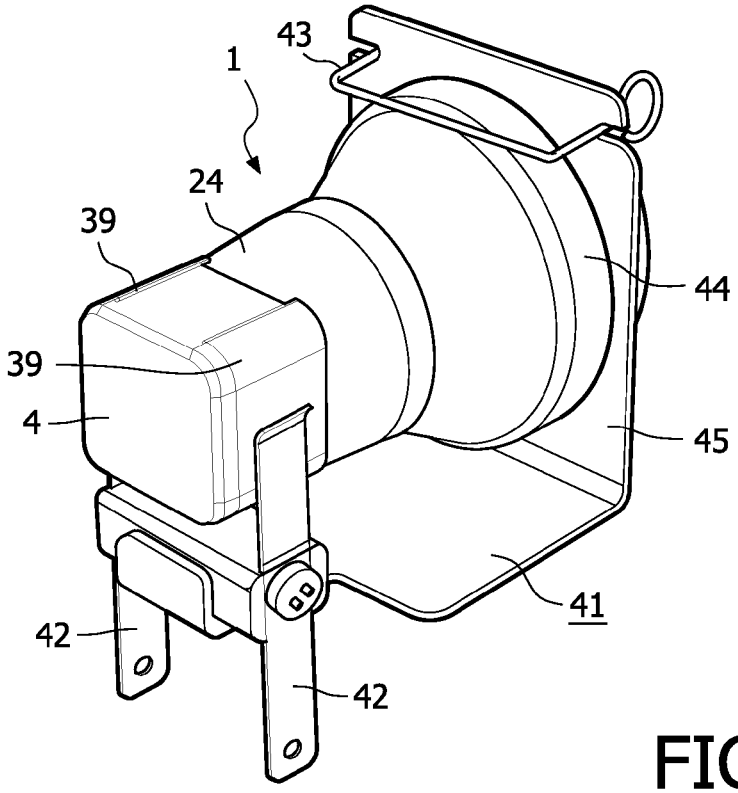
FIG. 3B shows the embodiment of the unit of FIG. 3A, seated in the holder.

FIGS. 3A and 3B show a third, assembled embodiment of a unit 1 according to the invention. The lamp cap 4 is made of only one integral part having two spring clamps 39 provided opposite each other on the outer surface 24 of the lamp cap. Mounting of the unit 1 into a holder 41 is simplified as after the unit is seated in place, electrical contact is readily realized with holder contacts 42. Furthermore, the holder has a spring clip 43 via which the unit is kept securely positioned in the holder together with the holder contacts by a reference edge 44 of the reflector against a reference plate 45 of the holder. As is shown in FIG. 3A, the metal cladding 22 is painted black for enabling better cooling of the unit. Furthermore, the metal cladding extends, by means of an extending portion 48, the reflecting portion of the reflector. The extending portion in this embodiment of the unit is provided with four cooling slits 49, of which only one slit is visible, for enabling efficient cooling of the unit. The slits are provided with a metal mesh to counteract that upon failure of the unit due to explosion of the lamp vessel, hot fragments are scattered into the environment.

Figure 4:
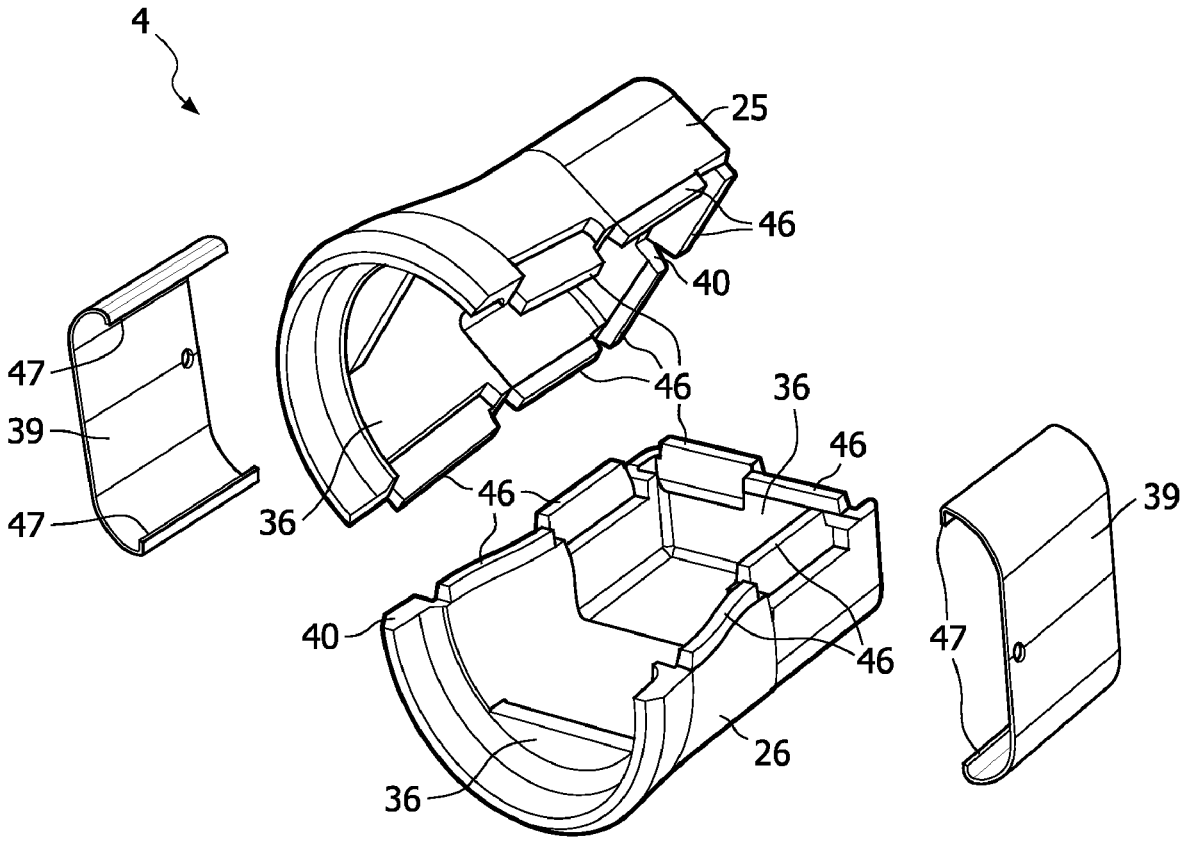
FIG. 4 shows an exploded view of a lamp cap according to the invention.

FIG. 4 shows an exploded view of the lamp cap 4 comprising a first 25 and a second mating part 26, which parts are identical, i.e. congruently shaped. Each part has an inner surface 38 which is provided with a respective profiled structure 36, i.e. in FIG. 4 a protrusion, enabling it to be seated in a respective indentation in the neck-shaped portion of a reflector (see FIG. 2). The mating parts have walls 40 ending with teeth 46 which perfectly match each other during assembly of the two mating parts. In assembled position, the teeth 46 of the mating parts partly overlap each other, thus together forming a securely closed combined wall of the cavity and counteracting mutual displacement of the mating parts. Also shown are spring clips 39 serving as electrical contacts 17 of the lamp cap 4. The spring clamps have hook-shaped ends 47 which grip into grooves (not shown) provided in the walls of the mating parts.

The invention claimed is:

1. A lamp and reflector unit comprising:

a lamp vessel comprising a wall enclosing in a gastight manner a space having a light emitting element arranged therein, and comprising electrical current conductors which extend from the light emitting element through the wall to the exterior;

a reflector having a reflecting portion extending between a neck opening formed in a neck and a light emission window of the reflector, the reflecting portion defining an optical axis, the lamp vessel being arranged in the reflector such that the optical axis extends through the light emitting element;

a lamp cap fixed to the lamp and reflector unit proximate to the neck opening, the lamp cap comprising electrical contacts, each electrical contact being electrically connected with a respective electric current conductor, the electrical contacts being provided substantially opposite to each other on an outer surface of the lamp cap, wherein said lamp cap has a substantially identical first and second mating part, each of said first and second mating part having a pair of grooves;

said electrical current conductors being a first spring clamp and a second spring clamp, each of said spring clamps having hook-shaped ends which grip into said pair of grooves formed in said mating parts;

wherein said first and second spring clamps at least partially retaining said first and said second mating parts of said lamp cap together;

each of said first and said second mating part further having an inner surface having a protrusion, said protrusion seating in first and second indentations formed in respective indentations formed in said neck of said reflector;

said first and said second mating parts further having interlocking teeth on facing walls which interlock and overlap to securely close a combined wall of a cavity formed by said first and said second mating parts.

2. A capped lamp and reflector unit as claimed in claim 1, wherein the reflector further comprises a hollow neck-shaped portion at the neck opening, the lamp vessel having at least one seal-as a part of its wall, via which seal the lamp vessel is fixed in the hollow neck-shaped portion, the lamp cap being provided around the neck-shaped portion.

3. A capped lamp and reflector unit as claimed in claim 2, wherein the lamp cap is made of UV-blocking material and has said cavity with one open side, the neck of the reflector extending via the open side into the cavity and being fixed therein.

4. A capped lamp and reflector unit as claimed in claim 1, wherein the neck-shaped portion has a profiled structure on an outer surface and each mating part has a mating profile-on an inner surface, which upon assembly results in the lamp cap and the neck-shaped portion of the reflector being interlocked.

5. A capped lamp and reflector unit as claimed in claim 1, wherein the reflector has an outer surface comprising a metal cladding.

6. A capped lamp and reflector unit as claimed in claim 1, wherein the reflector-comprises a transparent lid-at the light emission window.

* * * * *